US006273833B1

(12) United States Patent
Murphy

(10) Patent No.: US 6,273,833 B1
(45) Date of Patent: Aug. 14, 2001

(54) GOLF BALL AND TEE PLACER

(76) Inventor: Kerry Murphy, 2581 Lepp Ave., Niagara Falls, Ontario (CA), L2J 2B9

( * ) Notice: Subject to any disclaimer, the term of this patent is extended or adjusted under 35 U.S.C. 154(b) by 0 days.

(21) Appl. No.: 09/413,017

(22) Filed: Oct. 6, 1999

(51) Int. Cl.[7] ..... A63B 57/00
(52) U.S. Cl. ..... 473/386
(58) Field of Search ..... 473/386, 286, 473/387, 284, 251; 294/19.2

(56) References Cited

U.S. PATENT DOCUMENTS 1,852,956 * 4/1932 Czichos ..... 473/284
1,863,140 * 6/1932 Mulvaney ..... 473/386
2,606,764 * 8/1952 Mason ..... 473/386
2,943,856 * 7/1960 Eimerman ..... 473/386
3,074,719 * 1/1963 McKee ..... 473/386
4,313,604 * 2/1982 Baxter ..... 473/386
4,526,369 * 7/1985 Phelps ..... 473/386
5,011,150 * 4/1991 Averill ..... 473/284
5,060,996 * 10/1991 Garnes ..... 294/19.2
5,540,432 * 7/1996 Keller ..... 473/386
5,775,751 * 7/1998 Nelson ..... 294/19.2
6,095,930 * 8/2000 Siddall ..... 473/251

* cited by examiner

*Primary Examiner*—Steven Wong

(57) ABSTRACT

The present invention A golf ball and tee placer comprises a tee holder including an aperture having adhesive putty therein for releasably holding a tee head in said tee holder. The tee holder is for placing tees vertically into the ground by urging the tee holder with the tee downwardly into the ground. The tee holder adapted to leave the tee in the ground by subsequently urging the tee holder upwardly away from the ground. In addition the golf ball and tee placer comprises a mechanism for preselectively controlling the depth of penetration of the tee into the ground when the tee holder is used for urging the tee into the ground, thereby leaving the tee in the ground at a preselected tee height.

10 Claims, 10 Drawing Sheets

FIG - 1
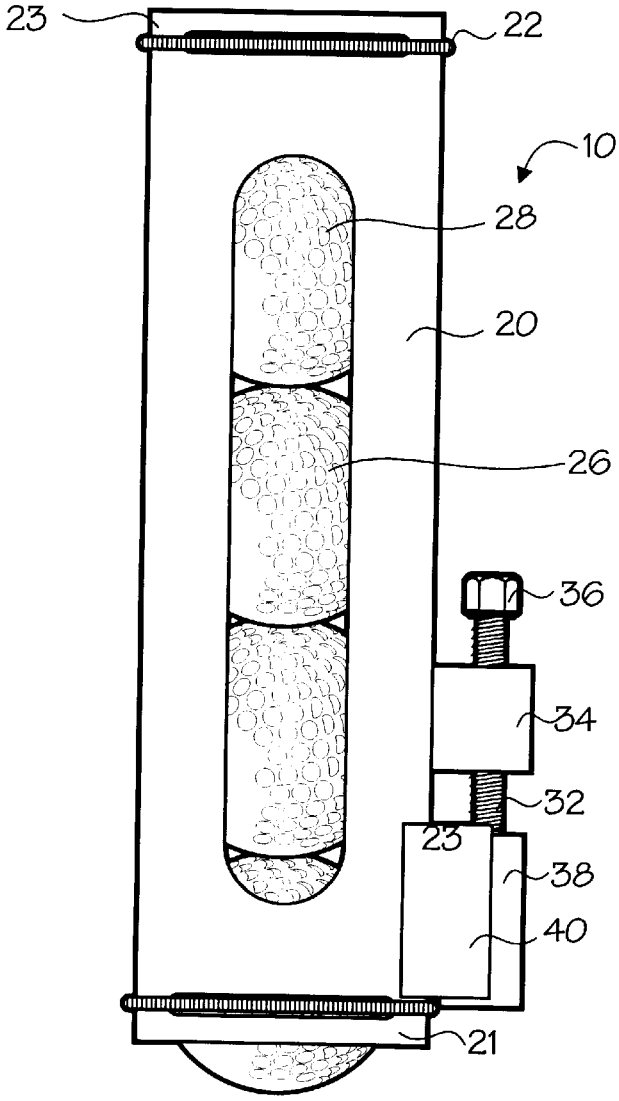
FIG - 3
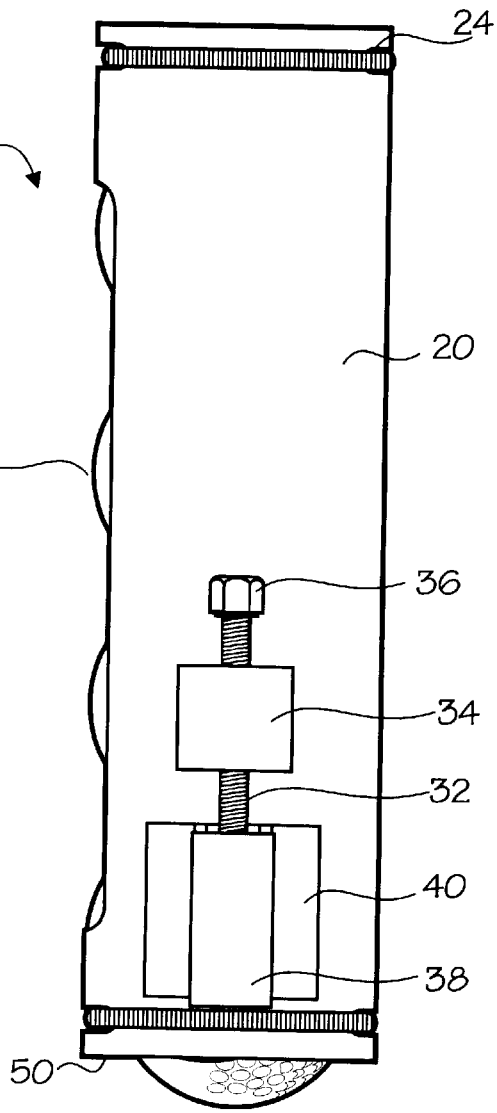
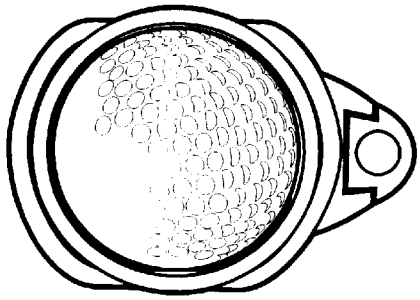
FIG - 2
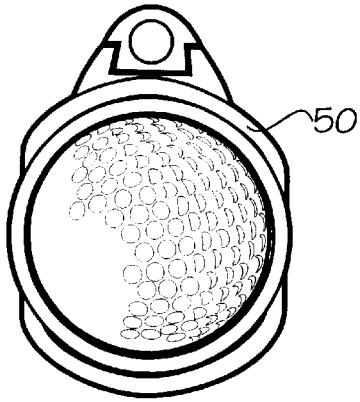
FIG - 4

23
20
36
32
34
38
46
55
43
43
42
22
24
50
54
52
70
45

130
112
102
110

104
136
100
108
108

292

226

GOLF BALL AND TEE PLACER

FIELD OF THE INVENTION

The field of this invention relates to golf ball and golf tee devices and in particular relates to golf ball & tee placing devices.

BACKGROUND OF THE INVENTION

The game of golf is played with a golf ball which is often teed up on a tee in order to position the ball a predetermined height above the ground."Teeing up a ball", as it is called, is usually carried out on the first shot of every hole on a golf course. A golf tee is placed into the ground at a predetermined height in order to place a ball onto the top of the golf tee so that the ball rests upon the golf tee at a predetermined height above the ground.

Currently the practice is to place a golf tee into the ground manually by hand, wherein the distance of the head of the tee above the ground is judged by eye sight of the player. As a result the tee height can be variable from one tee placement to the next depending upon how well a player can judge the height of the top of the tee above the ground.

In addition, often it is difficult to get the tee into the ground particularly where the ground is very hard and dried out and therefore, requiring a great deal of force in order to drive the tee into the ground. The tee is normally pushed into the ground using the thumb and/or fingers and this limits the amount of force that can be placed upon the tee in order to get it to the right height above the ground.

Therefore, it is desirable to have a device which will place a tee into the ground at a pre-determined height and avoids having to use finger pressure in order to drive the tee into the ground. In addition, it would be desirable to have a device which can consistently place the tee into the ground at the same height each time a new tee is placed into the ground.

The game of golf also requires picking up and placing balls onto the ground in various locations throughout the game. This requires the player to stoop over many times throughout the course of the game to either pick-up and/or place a ball onto the ground. Similarly the player must stoop considerably in order to place the tee into the ground.

Therefore, it is also desirable to have a device which minimizes stooping during the game of golf by providing a device which will place the tee into the ground without having to stoop as far down and/or be able to pick-up a ball without having to stoop as far down.

SUMMARY OF THE INVENTION

The present invention a A golf ball and tee placer, comprises:

a) a tee holder including a means for releasably holding a tee head in said tee holder, said tee holder for placing tees vertically into the ground by urging said tee holder with said tee downwardly into the ground, and said holding means adapted for leaving said tee in said ground by subsequently urging said tee holder upwardly away from the ground; and b) a means for preselectively controlling the depth of penetration of said tee into the ground when said tee holder is used for urging said tee into said ground, thereby leaving said tee in the ground at a preselected tee height.

Preferably said controlling means includes a stop surface rigidly connected to said tee holder which makes contact with the ground surface when said tee has penetrated the ground a predetermined amount thereby preventing further penetration of said tee into said ground leaving said tee in the ground at a preselected tee height. Preferably said controlling means includes a means for adjusting the distance between the stop surface and the tee head when said tee head is placed in said tee holder, such that one can adjust the tee height of the tee above the ground. Preferably said golf ball and tee placer is adapted to be held in a hand. Preferably said holding means includes a tee aperture dimensioned to slidably receive said tee head therein.

Preferably said holding means includes and a means for adhesively holding said tee head in said aperture.

Preferably said adhesive holding means includes putty adhesive housed within the aperture for contacting the tee head surface and releasably adhesively holding the tee head in said aperture.

Preferably said holding means includes a means for releasably biassing said tee within said aperture.

Preferably said biassing means includes wire springs for applying bias against said tee head holding said tee against said stop block.

Preferably said tee placer further comprises a frame for mounting said tee holder thereon such that said frame can be easily held in a hand.

Preferably said frame includes a tube dimensioned and adapted to receive golf balls therein, said tube having a bottom end and a top end.

Preferably said tube bottom end is said stop surface.

BRIEF DESCRIPTION OF THE DRAWINGS

For a better understanding of the present invention and to show more clearly how it may be carried into effect, reference will now be made by way of example only to the accompanying drawings in which:

FIG. 1 is a side elevational view of the present invention a golf ball and tee placer;

FIG. 2 is a bottom elevational view of the present invention a golf ball and tee placer;

FIG. 3 is a alternate side elevational view of the golf ball and tee placer;

FIG. 4 is a alternate bottom elevational view of the golf ball and tee placer;

DETAILED DESCRIPTION OF THE PREFERRED EMBODIMENT

Definitions

Putty adhesive: Any putty adhesive like material which is known in the art to be suitable for the present application including nut not limited to mastic putty, plumbers putty, latex putty, silicone putties, and any other latex, silicone, rubber or other materials which are suitable for the present application. Some suitable commercially available putty adhesives are sold under the tradenames Handi-Tak®, Tac'n'Stick®, Holdit®, and Instant Tact®.

Tee: refers to a wood or plastic golf tee used for placing into the ground and supporting a ball on top. The upper part of the tee is referred to the tee head.

Description

Figure 9:
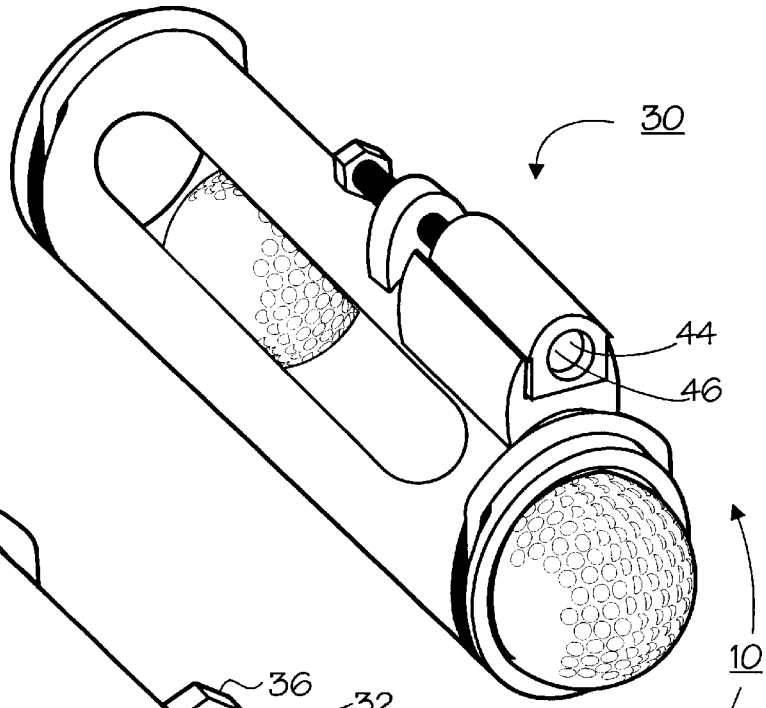
FIG. 9 is a top perspective view of the golf ball and tee placer.
Figure 10:
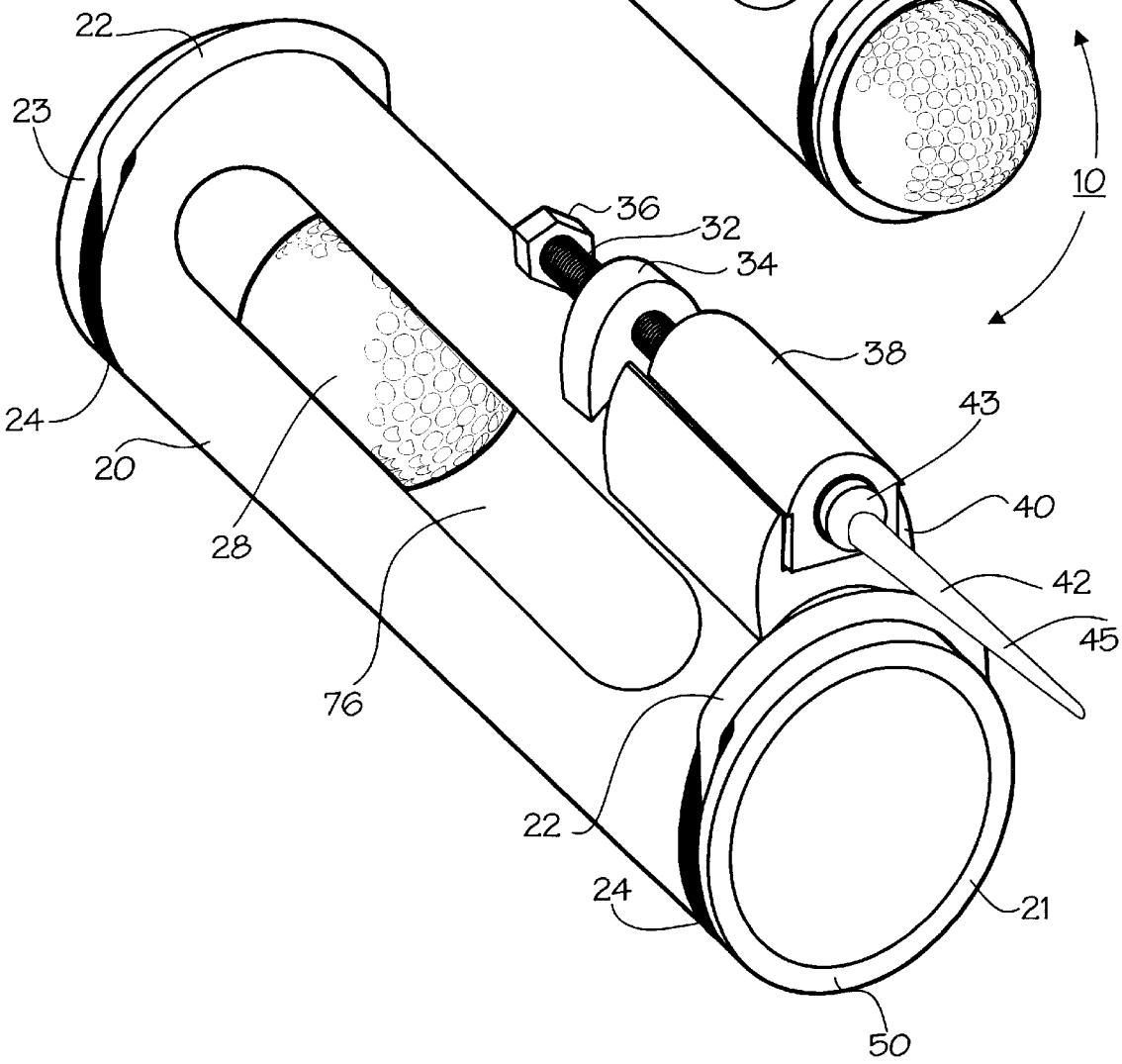
FIG. 10 is a perspective view of the golf ball and tee placer shown with a tee in place.

Referring firstly to FIGS. 9 and 10 in particular, the present invention a golf ball and tee placer shown generally as 10 comprises a tube 20 having a bottom end 21 and a top end 23 and having grooves 24 proximate bottom end 21 and top end 23 for partially receiving springs 22 therein.

Golf ball and tee placer 10 further comprises a tee holder shown generally as 30 including rail 40 mounted onto tube 20, slide 38 having a tee head aperture 44 which is partially filled with putty adhesive 46, a screw guide 34, a positioning screw 32 and a thumb adjuster 36.

Figures 7, 8:
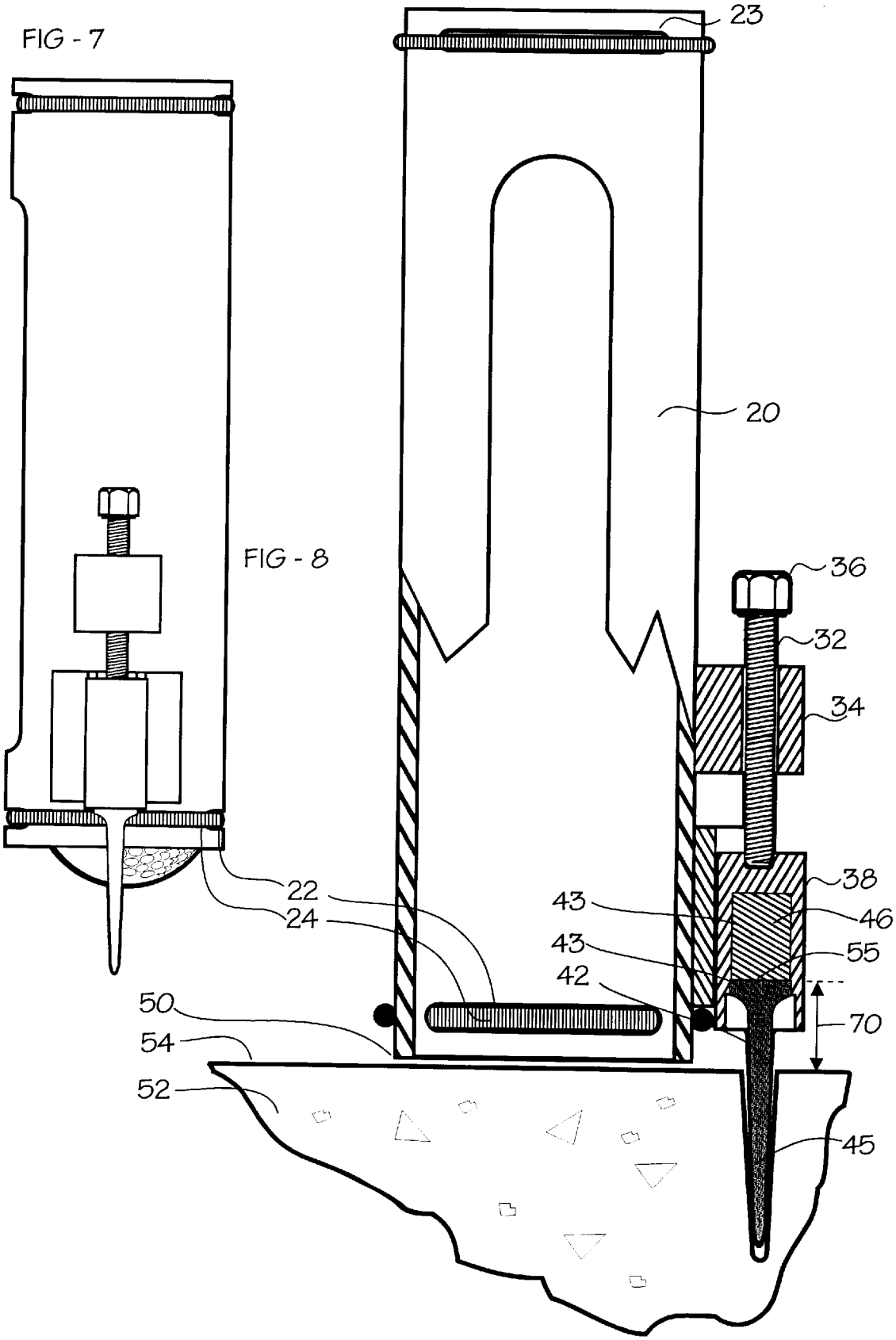
FIG. 7 is a side elevational view of the golf ball and tee placer.
FIG. 8 is a partial cross-sectional view of the golf ball and tee placer showing the device mounted in situ onto the ground.

Referring now to FIGS. 7 and 8 as well, tube 20 is dimensioned to receive slidably therein, golf ball 28. The length of tube 20 will determine how many golf balls 28 can be accommodated within the length of tube 20. Mounted onto tube 20 is tee holder 30 and in particular rail 40 and screw guide 34 are rigidly connected to the outer diameter of tube 20.

Slide 38 cooperates with rail 40 and is adapted to slide longitudinally along rail 40 in accordance with the location of positioning screw 32. As shown in FIGS. 7, 8, 9 and 10, rail 40 and slide 38 a slidably connected with a dove tail arrangement in order to hold slide 38 onto rail 40. Positioning screw 32 is rotatably fastened to one end of slide 38 and is screwably threaded through screw guide 34 which is rigidly fastened to tube 20. Thumb adjuster 36 is used to rotate positioning screw 32 thereby, longitudinally moving positioning screw 32 through screw guide 34.

Referring now to FIGS. 1 through 6 as well, the length of tube 20 will determine how many golf balls 28 can be housed within tube 20. Preferably tube 20 has a slot 26 defined therein and dimensioned large enough to be able to place a finger through slot 26 and touch golf balls 28. The inner diameter of tube 20 is dimensioned to receive slidably therein golf balls 28. On both the bottom end 21 and the top end 23 of tube 20 are grooves 24 dimensioned to receive springs 22. Springs 22 fit around the outside of tube 20 and pass through grooves 24, thereby impinging upon the outer diameter of golf ball 28 as it passes by springs 22. Springs 22 and grooves 24 are dimensioned and adapted to retain golf balls 28 within tube 20 and are also adapted to be able to pick-up golf ball 28.

In use golf ball and tee placer 10 is used primarily to place tee 42 at a predetermined and consistent tee height 70 relative to ground surface 54 of ground 52. Tee head 43 of tee 42 is placed manually into tee head aperture 44 of slide 38 and is held in place by the suction of putty adhesive 46 as well as the adhesive forces of putty adhesive 46 against tee head surface 55.

In order to place tee 42 into ground 52, golf ball and tee placer 10 is manually positioned against the ground as shown in FIG. 8, such that stop surface 50 of tube 20 makes substantially flush contact with ground surface 54 of ground 52. In the position shown in FIG. 8, tee spike 45 of tee 42 is forced into ground 52 and tee 42 is installed in the ground having a tee height 70 being the distance between the top of tee head 43 and ground surface 54. In this way it is apparent that tee 42 can consistently be placed into ground 52 at a uniform tee height 70 each time it is used.

Tee height 70 can be very finely adjusted by turning thumb screw adjuster 36 which in turn rotates positioning screw 32 which threadably moves positioning screw 32 through screw guide 34 and slidably moves slide 38 along rail 40 thereby varying tee height 70 to the desired height. Tee height 70 can also be adjusted by increasing or decreasing the amount of putty adhesive 46 within tee head aperture 44.

It would be apparent to those skilled in the arts that other methods of holding tee 42 in tee aperture 44 can be used. For example as shown in FIG. 6 wire springs 80 can be arranged longitudinally along tee head aperture 44 to impinge against the sides of tee head 43 and/or tee head aperture 44 can be adapted to frictionally receive tee head 43 and/or any other means known in the mechanical arts for releasably receiving and holding tee 42 into tee head aperture 44 can be used and adapted with the present invention.

Figure 5:
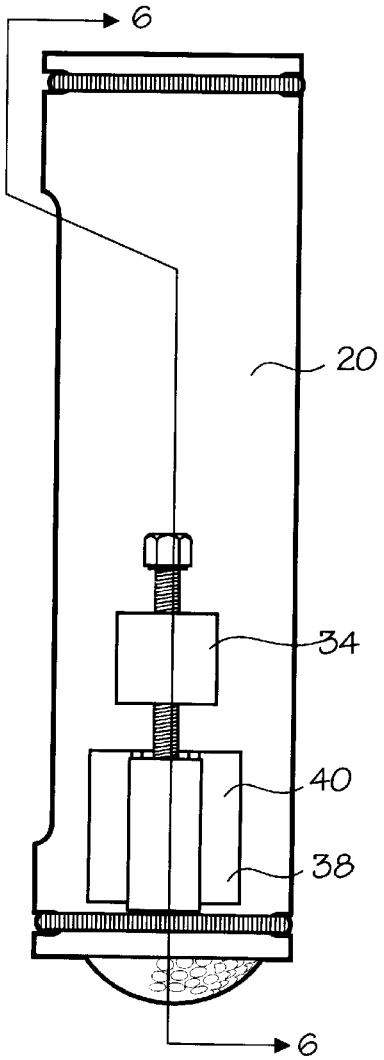
FIG. 5 is a side elevational view of the golf ball and tee placer.
Figure 6:
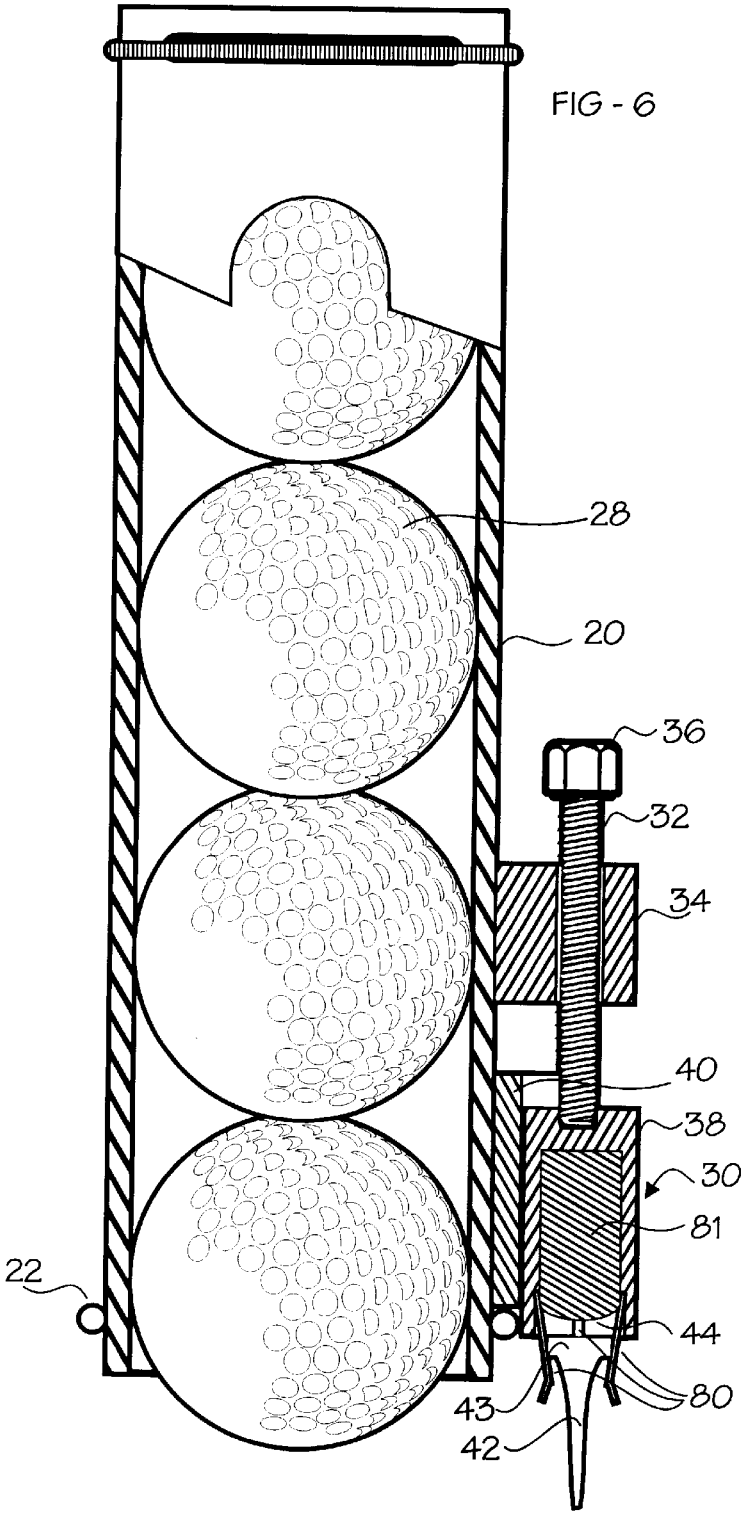
FIG. 6 is a partial cut away cross-sectional view of the golf ball and tee placer taken along line 6—6 of FIG. 5.

In particular an alternative to putty adhesive is shown in FIG. 6. Three or four small wire springs 80 mounted longitudinally within tee head aperture 44 provide resilient biasing forces against the sides of tee head 43. The biasing force is enough to hold tee 42 against stop block 81 in tee holder 30 but will release tee 42 when implanted in the ground. Any other method known in the art for holding tee 42 in tee head aperture 44 can be used.

In addition to using golf ball and tee placer 10 for consistently placing of tees 42 at a consistent tee height 70 into ground 52, tube 20 also can store golf balls 28 as shown in FIGS. 6. FIG. 6 in fact shows four golf balls housed within tube 20 and depending upon the length of the tube more or fewer golf balls can be stored within tube 20.

In order to use golf ball and tee placer 10 for picking up or placing golf balls 28 off or onto the ground surface 54 or onto a tee 42, coil springs 22 are adapted to snugly fit around the circumference of tube 20 and fit within grooves 24 which are dimensioned to receive the diameter of coil springs 22 such that when a ball 28 enters or exits through bottom end 21 or top end 23, the outer diameter of golf ball 28 impinges against springs 22 and the biasing force of springs 22 clamp onto the outer diameter of golf ball 28 thereby retaining golf ball 28 within tube 20. Preferably springs 22 and grooves 24 are dimensioned to be able to hold and grip golf ball 28 when only one third of the diameter of the golf ball is projecting into tube 20.

Once golf ball 28 has entered the main body of tube 20, springs 22 passing through grooves 24 present a barrier within tube 20 to prevent golf balls 28 from escaping from either the bottom end 21 or top end 23 of tube 20 unless force is applied to a golf ball 28. Therefore, golf ball and tee placer 10 also acts as a golf ball storage tube as well as a device which can be used to pick-up a golf ball or place a golf ball.

Golf ball 28 is picked up simply by placing tube 20 over the outer diameter of a golf ball 28 thereby urging golf ball 28 into the inner diameter of tube 20, and past springs 22. Golf ball 28 is deposited simply by urging golf ball 28 out of the inner diameter of tube 20, and past springs 22.

Slot 26 defined in tube 20 is dimensioned to allow the finger of a person not shown to pass through slot 26 in order to urge a golf ball 28 out of bottom end 21 or top end 23. Thereby golf balls 28 can be placed upon a tee by urging golf ball 28 out of tube 20 by placing a finger through slot 26 and urging golf ball 28 out of either end of tube 20. Golf ball 28 will exit from tube 20 if enough force is applied to deform springs 22 thereby allowing golf ball 28 to pass by springs 22.

Alternate Embodiment of Golf Ball and Tee Placer

Figure 23:
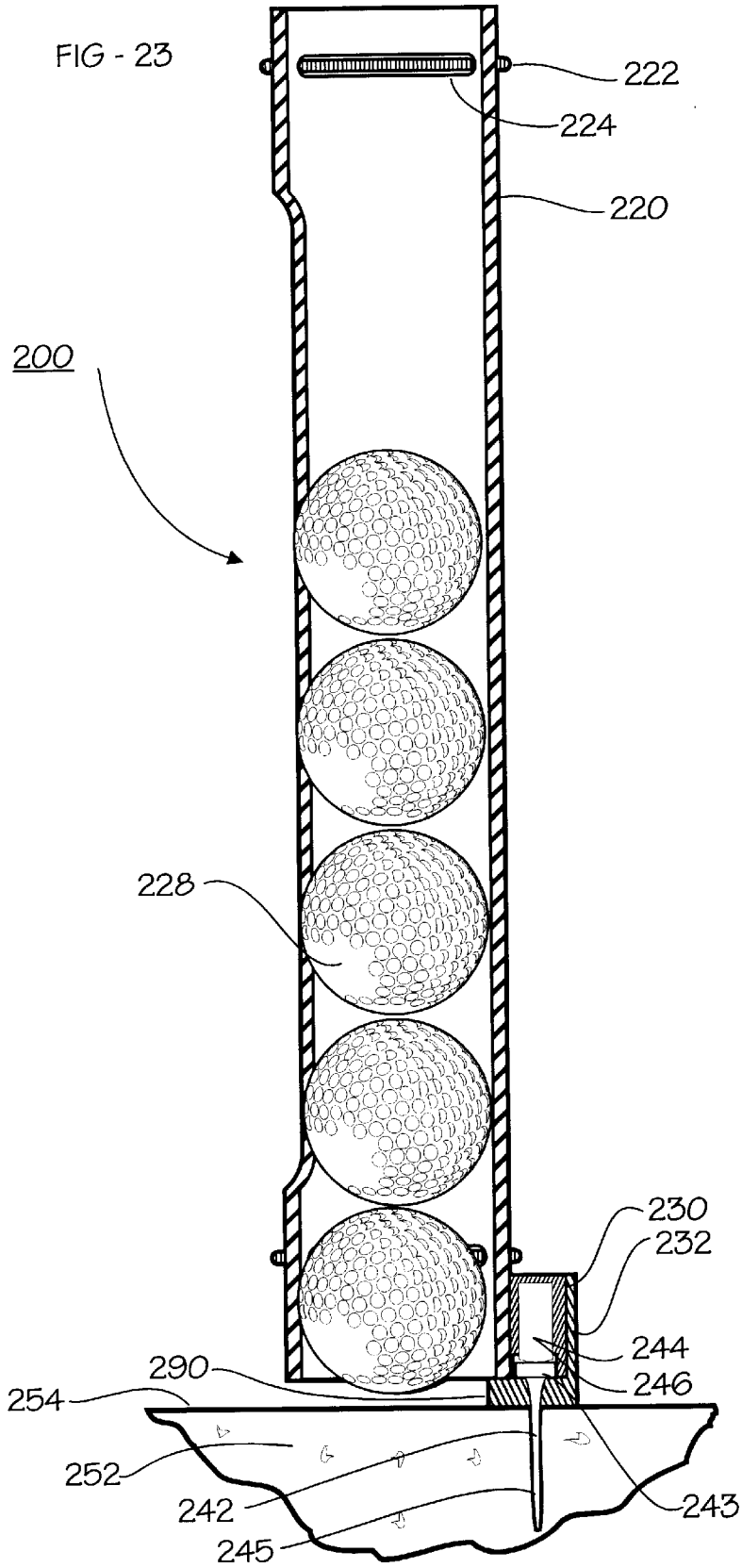
FIG. 23 is a cross-sectional elevational view of the golf ball and tee placer shown in FIGS. 18 and 20.
Figure 24:
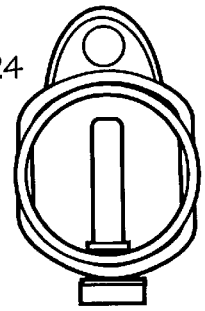
FIG. 24 is a bottom elevational view of the golf ball and tee placer shown in FIG. 25.
Figure 26:
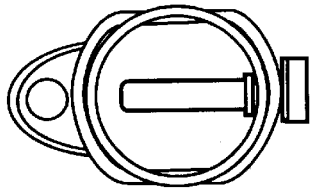
FIG. 26 is a bottom elevational view of the golf ball and tee placer shown in FIG. 27.

Depicted in FIGS. 18 through 29 is an alternate embodiment of the present invention, a golf ball and tee placer shown generally as 200. Referring specifically to FIG. 23 golf ball and tee placer 200 comprises tube 220, spring 222, groove 224, tee holder 230, having a body 232 and aperture 244 defined within a tee holder 230 and putty adhesive 246 within tee head aperture 244. Tee head aperture 244 is a dimensioned to receive tee head 243 of tee 242.

Figure 29:
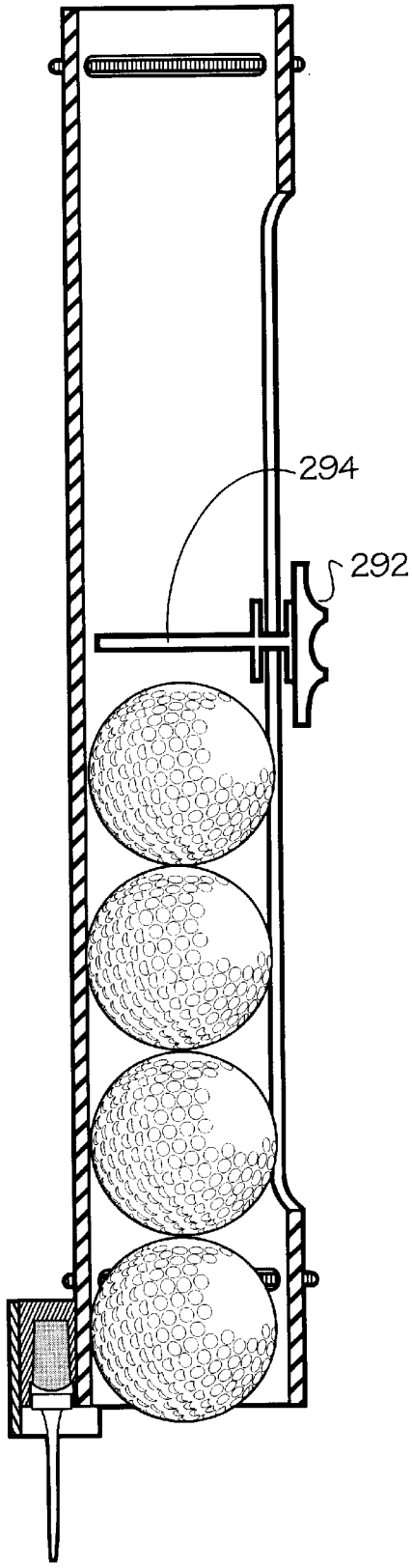
FIG. 29 is a cross-sectional elevational schematic view of the golf ball and tee placer shown in FIG. 25 and 27.

Similar to the previously described embodiment, (golf ball and tee placer 10), the present embodiment is similar except for the features of tee holder 230 as well as slot 226 having slide 292 with a slide arm 294 projecting perpendicularly from slide 292 as depicted in FIG. 29.

Tee holder 230 in addition has a tee stop 290 which impinges against ground surface 254 of ground 252.

Putty adhesive 246 is of the type which holds tee head 243 in tee head aperture 244 by suction created by putty adhesive 246 impinging upon tee head 243 as well as by adhesive forces of putty adhesive 246 upon tee head 243. As previously described, it is also possible to use wire springs 80 as shown in FIGS. 6 mounted within tee head aperture 244.

The present embodiment of the invention, a golf ball and tee placer 200 is used in almost analogous fashion as described above for golf ball and tee placer 10. The major differences are that tee holder 230 is not as finely adjustable as tee holder 30 was in the previous embodiment The height of the head above, ground surface 254 can be adjusted by varying the amount of putty adhesive 246 within tee head aperture 244 and/or by physically displacing tee holder 230 along the outer body of tube 220. In this regard tee holder 230 may have two or three distinct positions on which it can be mounted along tube 220. The position of tee holder 230 along tube 220 as well as the thickness of tee stop 220 will determine the position of tee head 243 above ground surface 254. Springs 222 and grooves 224 are analogous to springs 22 and 24 in the previous embodiment.

In use a tee 242 is manually placed within tee head aperture 244 and is releasably held within tee head aperture 244 as was the case also with tee head aperture 44 in the previous embodiment. In order to place a tee 242 into ground 252, tube 220 is urged such that tee spike 245 penetrates ground 252 until tee stop 290 makes contact with ground surface 254. Once this contact has been established, tube 220 can than be raised away from ground surface 254 leaving tee 242 at a predetermined and consistent height above ground surface 254. Tee 242 is left behind in ground 252 since the force of putty adhesive 246 upon tee head 243 is just enough to hold tee 42 in tee head aperture 244. This is also true for the previous embodiment, golf ball and tee placer 10. As discussed in the previous embodiment, other methods for releasably holding tee head 243 in tee head 244 such as wire springs 80 as shown in FIG. 6 can also be used.

Figure 25:
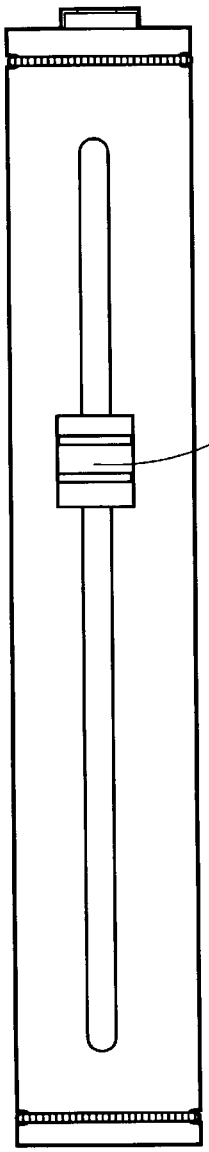
FIG. 25 is a side elevational view of an alternate embodiment of the present invention a golf ball and tee placer.
Figure 27:
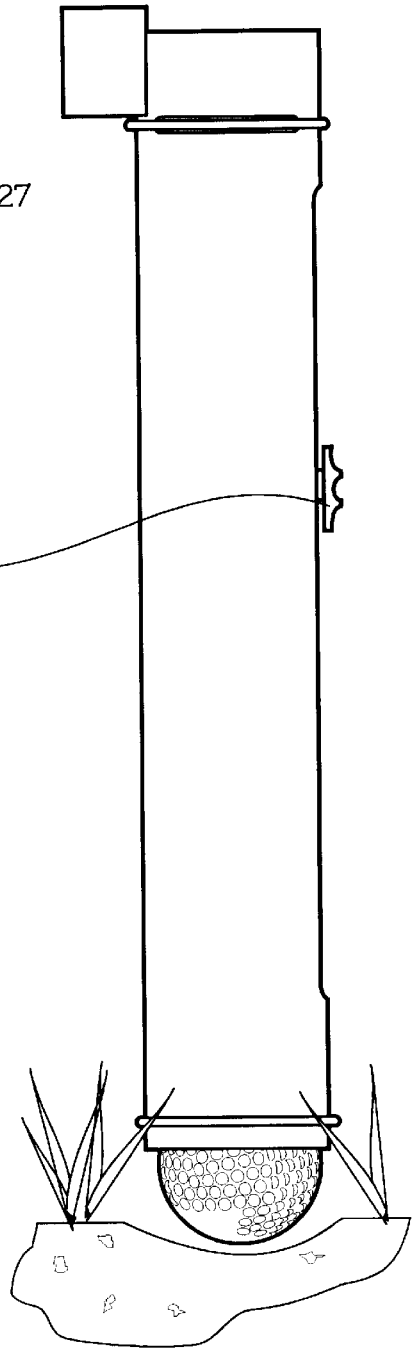
FIG. 27 is a side elevational view of the golf ball and tee placer showing picking up a golf ball from the ground.
Figure 28:
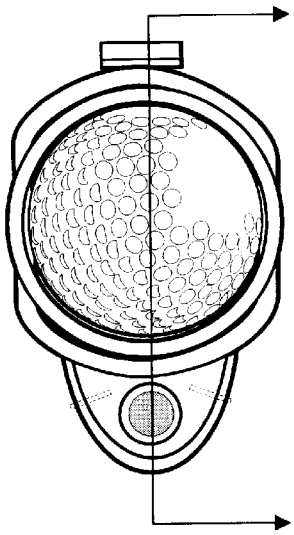
FIG. 28 is a bottom elevational view of the golf ball and tee placer shown in FIG. 29.

In addition, referring now specifically to FIGS. 25 and as well FIGS. 29, slot 226 has disposed therein a slot 292 having a slide arm 294 which penetrates through the diameter of tube 220. In this manner rather than placing a finger through slot 226, slide 292 is simply moved up or down along slot 226 such that slide arm 294 urges golf balls 228 out of either end of tube 220.

Springs 222, grooves 224 and the ability to pick-up golf balls and retain golf balls within 220 is analogous to the previous embodiment as described.

Alternate Embodiment Golf Ball Placer

Figures 11, 12:
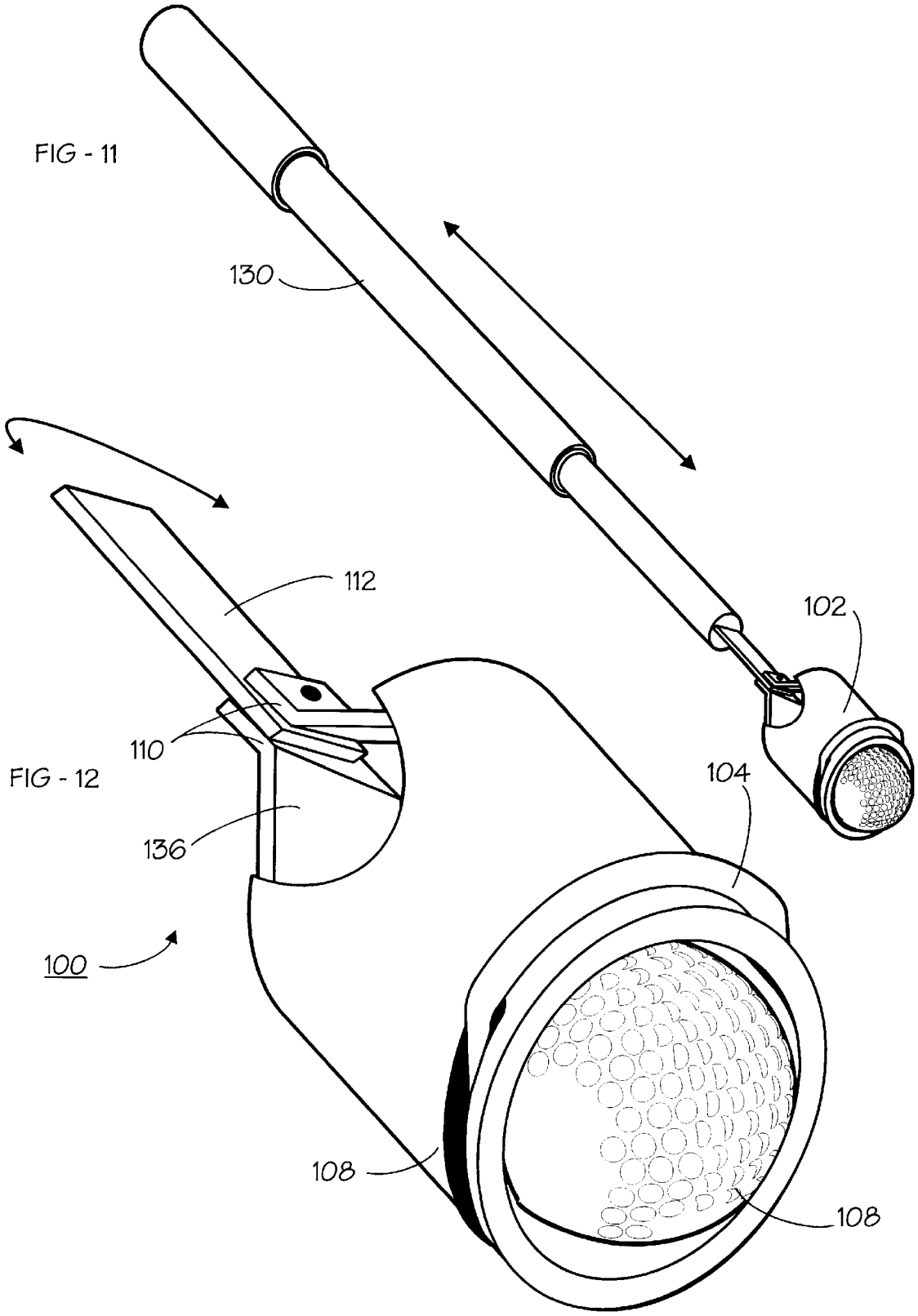
FIG. 11 is a perspective view of an alternate embodiment of the present invention, a golf ball placer.
FIG. 12 is an enlarged view of the golf ball placer.
Figure 13:
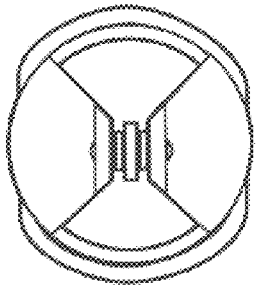
FIG. 13 is a top elevational view of the end of the golf ball placer.
Figure 14:
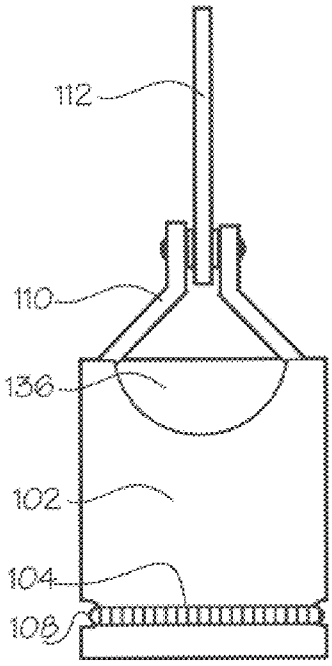
FIG. 14 is a side elevational view of the golf ball placer.
Figure 15:
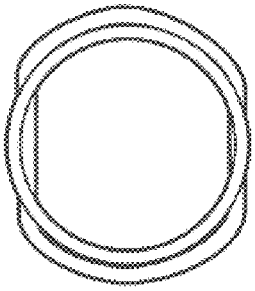
FIG. 15 is a bottom elevational view of the golf ball placer.

Referring now to FIGS. 11 through 17 which define an alternate embodiment of the present invention a golf ball placer showing generally as 100 comprising a tubular body 102 having a spring 104 mounted around the outer diameter of tubular body 102 and being received within grooves 108, tubular body 102 being adapted in dimension to receive the outer diameter slidably of golf ball 106 as shown in FIG. 12.

Optionally tubular body 102 is attached to a telescoping handle 130 using flanges 110 and a connecting member 112. Telescoping handle 130 is of the type known in the art and the connection between golf ball placer 100 and telescoping handle 130 can be of any type known in the art. Springs 104 and groove 108 as well as the diameter of tubular body 102 are dimensioned and adapted such that the outer diameter of golf ball 106 is impinged upon and gripped by spring 104 when approximately ⅓of the diameter of the golf ball is housed within tubular body 102. This is also true of the previous embodiments.

Figure 16:
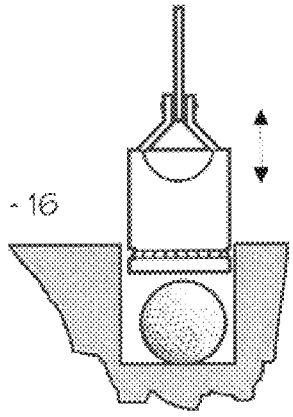
FIG. 16 is a schematic view showing the use of the golf ball placer.
Figure 17:
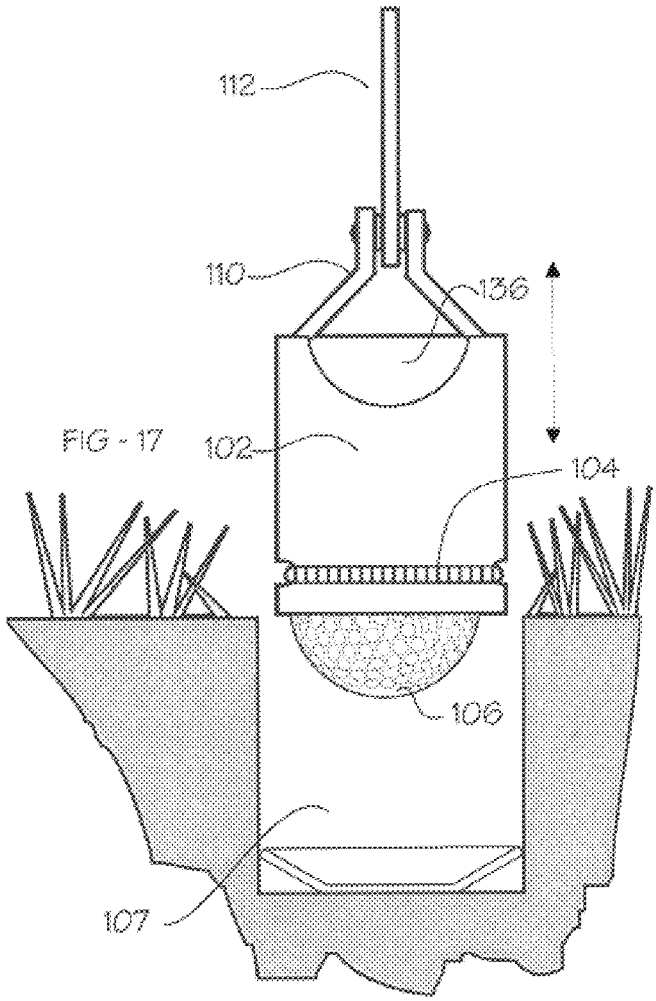
FIG. 17 is a schematic view of the present invention a golf ball placer shown retrieving a ball out of a golf hole.
Figure 18:
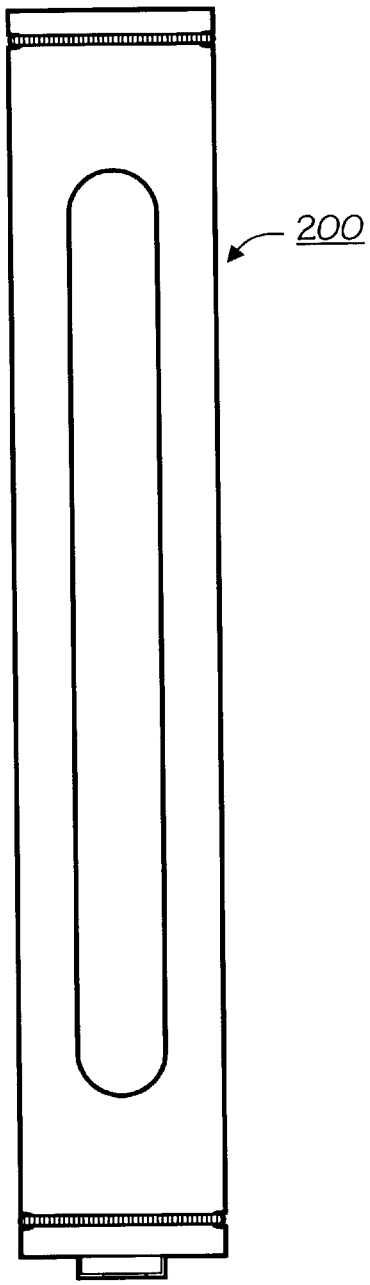
FIG. 18 is a side elevational view of an alternate embodiment of the present invention a golf ball and tee placer.
Figure 20:
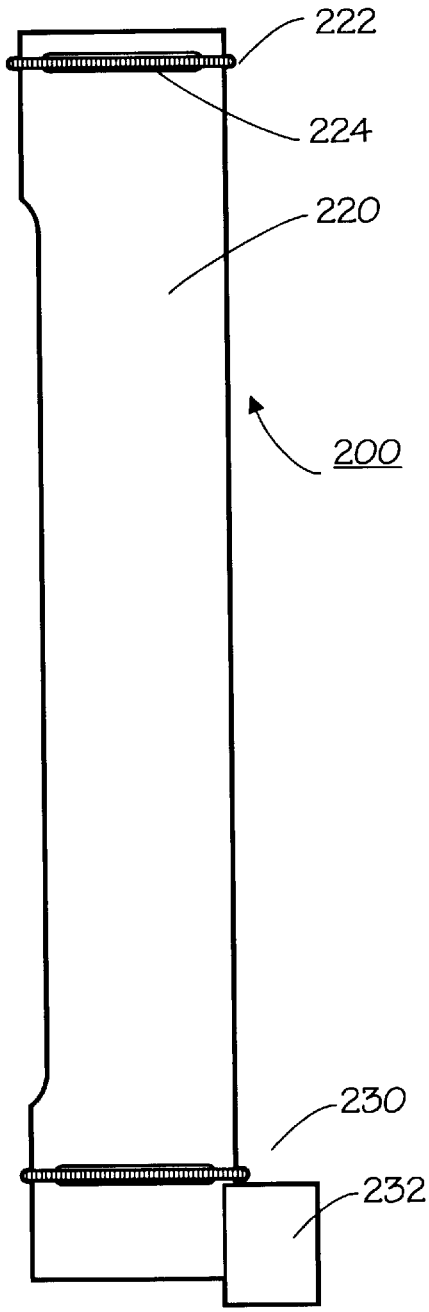
FIG. 20 is an alternate side view of the golf ball and tee placer shown in FIG. 18.
Figure 19:
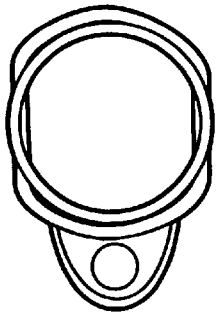
FIG. 19 is a bottom elevational view of the golf ball and tee placer shown in FIG. 18.
Figure 21:
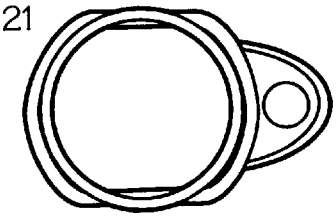
FIG. 21 is a bottom elevational view of the golf ball and tee placer shown in FIG. 20.
Figure 22:
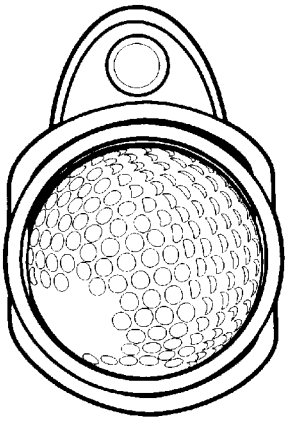
FIG. 22 is a bottom elevational view of the golf ball and tee placer shown in FIG. 23.

In this manner, golf ball placer 100 can be used to pick-up golf balls within holes as depicted in FIG. 16 and also from golf ball cups as shown in FIG. 17 and simply by placing a finger through finger opening 136 as shown in FIG. 112, golf ball 106 can be urged out of tubular body 102 for subsequent use.

It should be apparent to persons skilled in the arts that various modifications and adaptation of this structure described above are possible without departure from the spirit of the invention the scope of which defined in the appended claim.

I claim:

1. A tee placer for planting tees into the ground, said tee placer comprising:

a) a means for gripping said tee placer in a hand;

b) a tee holder operably connected to said gripping means, including a means for releasably holding a tee head in said tee holder, wherein tees are placed vertically into the ground with hand pressure by urging said tee placer together with a tee vertically downwardly towards the ground such that a tee penetrates into the ground;

c) with a tee placed in the ground, said holding means adapted for releasing a tee and leaving a tee in the ground upon urging said tee placer upwardly away from the ground;

d) a means for preselectivaly controlling the depth of penetration of said tee into the ground when said tee placer urges said tee into said ground, thereby leaving said tee in the ground at a preselected tee height; and e) wherein said holding means includes a means for adhesively holding said tee head surface of said tee to said tee holder such that only vertical upward urging of said tee placer is required to release said tee from said tee holder thereby ensuring said tee is not disturbed in its vertical alignment;

f) wherein said controlling means includes a stop surface rigidly connected to said tee holder which makes contact with the ground surface when a tee has penetrated the ground a predetermined amount thereby preventing further penetration of a tee into the ground leaving a tee in the ground at a preselected tee height;

g) wherein said controlling means further includes a means for adjusting the distance between the stop surface and the tee head when said tee head is placed in said tee holder, such that one can adjust the tee height of the tee above the ground; and h) wherein said adjusting means includes a slide having defined therein a tee aperture, dimensioned to slidably receive a tee head therein, and a cooperating rail for slidably engaging with said slide, such that said slide can be linearly urged along said rail and preselectively positioned along said rail for adjusting the distance between the stop surface and a tee head.

2. The golf ball and tee placer claimed in claim 1 wherein said adhesive holding means includes putty adhesive housed within the aperture for contacting the tee head surface and releasably adhesively holding the tee head in said aperture.

3. The tee placer claimed in claim 1 wherein said gripping means further comprises a frame for mounting said tee holder thereon such that said frame can be easily held in a hand.

4. The tee placer claimed in claim 3 wherein said frame includes a tube dimensioned and adapted to receive golf balls therein, said tube having a bottom end and a top end.

5. The tee placer claimed in claim 4 wherein said tube bottom end is said stop surface.

6. The tee placer claimed in claim 5 wherein said tube further including a means for releasably retaining golf balls within said tube.

7. The tee placer claimed in claim 6 wherein said tube retaining means includes a biassing means for applying a biassing force to the outer surface of a golf ball proximate the ends of said tube.

8. The tee placer claimed in claim 7 wherein said tube biassing means includes coil springs dimensioned and adapted to fit around the outer diameter of said tube proximate said ends, and received within circumferential grooves in said tubes such that the springs project into the inner diameter of said tube and apply a biassing force against a golf ball passing through said tube proximate said springs.

9. The placer claimed in claims 8 wherein said tube biassing means is adapted to apply biassing force great enough to grip the outer diameter of the golf ball and hold it against the force of gravity when at least one third of the diameter of the golf ball is within the tube.

10. The tee placer claimed in claim 1 wherein said adjusting means further comprises a positioning screw threadably passing through a screw guide, wherein one end of said positioning screw is attached to said slide and the other end of said positioning screw has mounted thereon a thumb adjuster such that when the positioning screw is rotated by turning said thumb adjuster, said slide is linearly urged along said rail for adjusting the distance between the stop surface and the tee head.

* * * * *